US012440023B2

(12) United States Patent
Lo

(10) Patent No.: US 12,440,023 B2
(45) Date of Patent: Oct. 14, 2025

(54) STORAGE BOX STRUCTURE

(71) Applicant: DELSUN CO., LTD., Tainan (TW)

(72) Inventor: Feng-Jung Lo, Deer Park, NY (US)

(73) Assignee: DELSUN CO., LD., Tainan (TW)

( * ) Notice: Subject to any disclaimer, the term of this patent is extended or adjusted under 35 U.S.C. 154(b) by 90 days.

(21) Appl. No.: 18/397,049

(22) Filed: Dec. 27, 2023

(65) Prior Publication Data

US 2025/0213038 A1 Jul. 3, 2025

(51) Int. Cl.
*A47B 87/00* (2006.01)
*A47B 96/20* (2006.01)

(52) U.S. Cl.
CPC ..... *A47B 87/008* (2013.01); *A47B 96/206* (2013.01)

(58) Field of Classification Search
CPC ..... A47B 87/008; A47B 96/206
USPC ..... 312/107, 108, 111, 257
See application file for complete search history.

(56) References Cited

U.S. PATENT DOCUMENTS 4,502,741 A * 3/1985 DeVries ..... A47B 87/0292 312/334.44
5,807,618 A * 9/1998 Shiota ..... A47B 96/205 428/116
6,688,712 B2 * 2/2004 Adams ..... E04B 1/3483 312/257.1
9,526,331 B2 * 12/2016 Vazquez ..... A47B 47/0041
2002/0109442 A1 * 8/2002 Hsu ..... A47B 47/042 312/263
2005/0035697 A1 * 2/2005 Chen ..... A47B 47/02 312/257.1
2011/0221318 A1 * 9/2011 Chen ..... A47B 88/941 312/263
2011/0318527 A1 * 12/2011 Susnjara ..... A47B 47/042 428/119
2014/0070684 A1 * 3/2014 Crabtree ..... F16B 12/02 312/265.5
2017/0336129 A1 * 11/2017 Cunningham ..... F25D 19/00

* cited by examiner

*Primary Examiner* — Kimberly T Wood
(74) *Attorney, Agent, or Firm* — LANWAY IPR SERVICES; Chun-Ming Shih

(57) ABSTRACT

A storage box structure includes two side boards, at least two laminates, multiple screws, and at least one back board. The at least two laminates are parallel and located between the two side boards. The at least one back board is located between the two side boards. Each of the two side boards has a side board body. The side board body is provided with multiple first screw holes. Each of the at least two laminates has a laminate body. The laminate body is provided with multiple second screw holes. Thus, any two adjacent storage box structures are assembled through the first screw holes, and any two stacked storage box structures are assembled through the second screw holes.

4 Claims, 10 Drawing Sheets

STORAGE BOX STRUCTURE

BACKGROUND OF THE INVENTION

Field of the Invention

The present invention relates to a furniture product and, more particularly, to a storage box structure.

Description of the Related Art

A storage box is used for placing and receiving articles. However, the conventional storage box has a fixed volume that cannot be adjusted (increased or decreased) according to the user's practical requirement so that the space for receiving the articles is not large enough. In addition, the conventional storage box may occupy a too large volume when the indoor space is limited.

BRIEF SUMMARY OF THE INVENTION

The primary objective of the present invention is to provide a storage box structure that is assembled arbitrarily. The number of the storage box structure is increased or decreased freely so that multiple storage box structures are assembled to form different storage spaces.

In accordance with the present invention, there is provided a storage box structure comprising two side boards, at least two laminates, multiple screws, and at least one back board.

The two side boards are upright and arranged in parallel. Each of the two side boards has a side board body. The side board body has a first face provided with at least one recess, at least two first slots, and at least one second slot. The at least two first slots are arranged serially and linearly from an upper edge to a lower edge of the side board body. The at least two first slots are parallel with each other. The at least one recess lies between the at least two first slots. The at least one second slot lies between a side of the at least one recess and a side of the side board body. A predetermined angle is defined between the at least one second slot and each of the at least two first slots. The side board body has a second face provided with multiple first screw holes penetrating the side board body and connected to the at least one recess. Each of the upper edge and the lower edge of the side board body is provided with multiple perforations connected to each of the at least two first slots. The two side boards are arranged symmetrically. The at least two first slots of the two side boards align with each other. The at least one second slots of the two side boards align with each other.

Each of the at least two laminates has a laminate body. The laminate body has a top face provided with multiple second screw holes penetrating the laminate body. The laminate body is provided with two insert portions extending from two sides of the laminate body. Each of the two insert portions is provided with multiple two-way screw bores which are directed toward a direction the same as that of the second screw holes. The at least two laminates are located between the two side boards. Each of the two insert portions of each of the at least two laminates is inserted into each of the at least two first slots of one of the two side boards. The two-way screw bores of each of the at least two laminates align with the perforations of one of the two side boards. The screws extend through the perforations of each of the two side boards from top to bottom and are screwed into the two-way screw bores of an uppermost one of the at least two laminates so that the uppermost one of the at least two laminates is locked onto each of the two side boards. The screws extend through the perforations of each of the two side boards from bottom to top and are screwed into the two-way screw bores of a lowermost one of the at least two laminates so that the lowermost one of the at least two laminates is locked onto each of the two side boards.

The at least one back board is located between the two side boards. The at least one back board has two sides each inserted into and locked in the at least one second slot of one of the two side boards.

According to the primary advantages of the present invention, the storage box structure comprises laminates of different numbers including two, three, four or the like. In addition, any two adjacent storage box structures are assembled through the first screw holes, and any two stacked storage box structures are assembled through the second screw holes.

Thus, multiple storage box structures are assembled freely by the user to form a storage cabinet with different storage spaces according to the user's various requirements. In such a manner, the storage box structure is flexible to satisfy the user's requirement in use.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
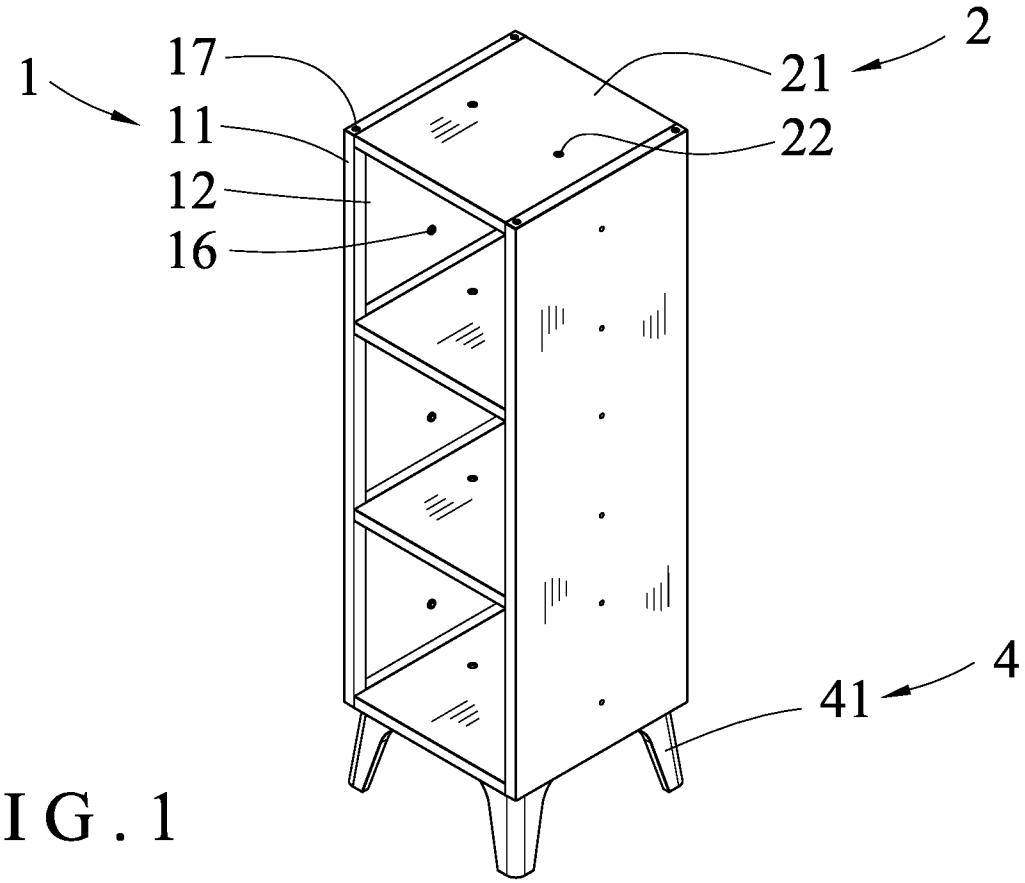
FIG. 1 is a perspective view of a storage box structure in accordance with the preferred embodiment of the present invention.
Figure 2:
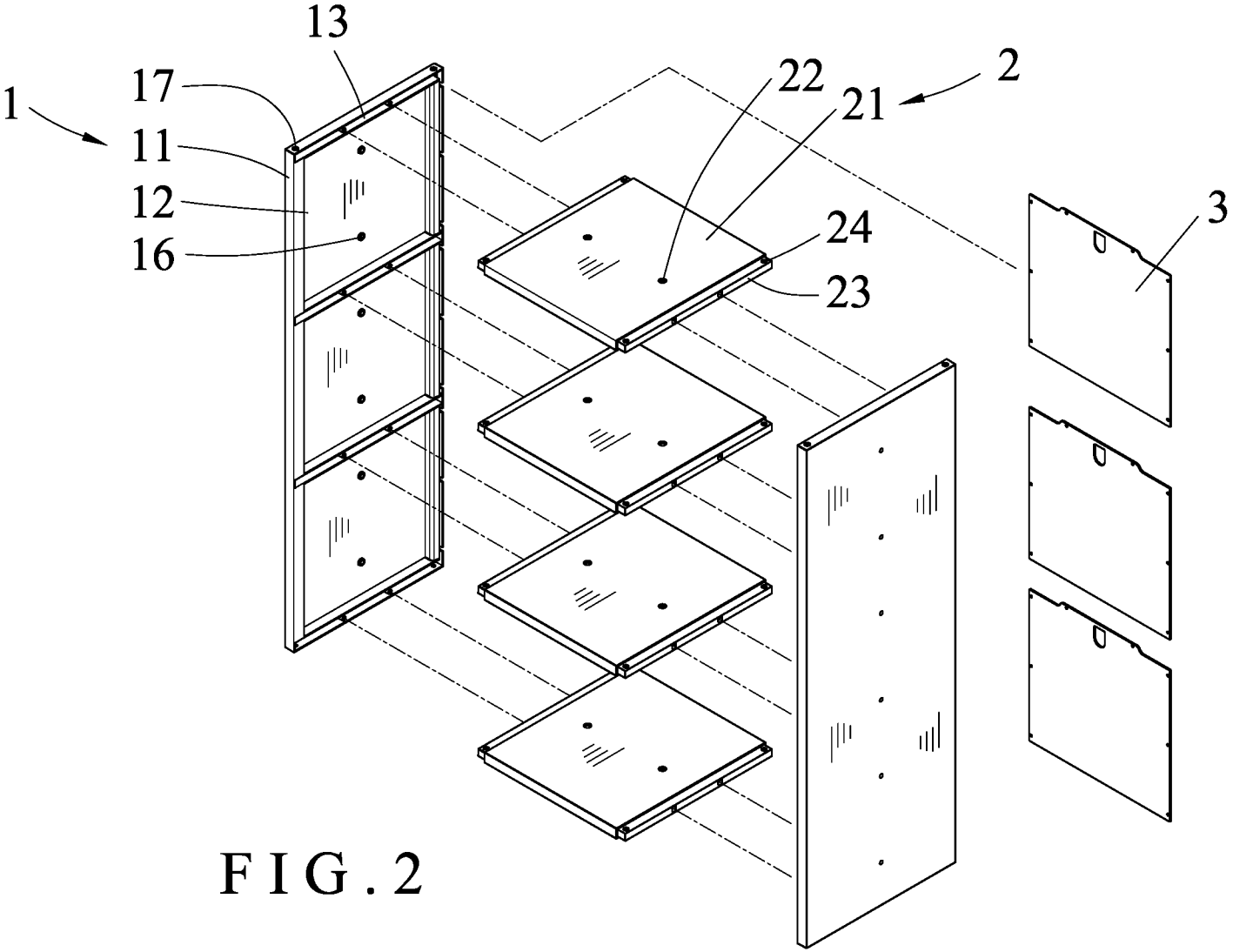
FIG. 2 is an exploded perspective view of the storage box structure in accordance with the preferred embodiment of the present invention.
Figure 3:
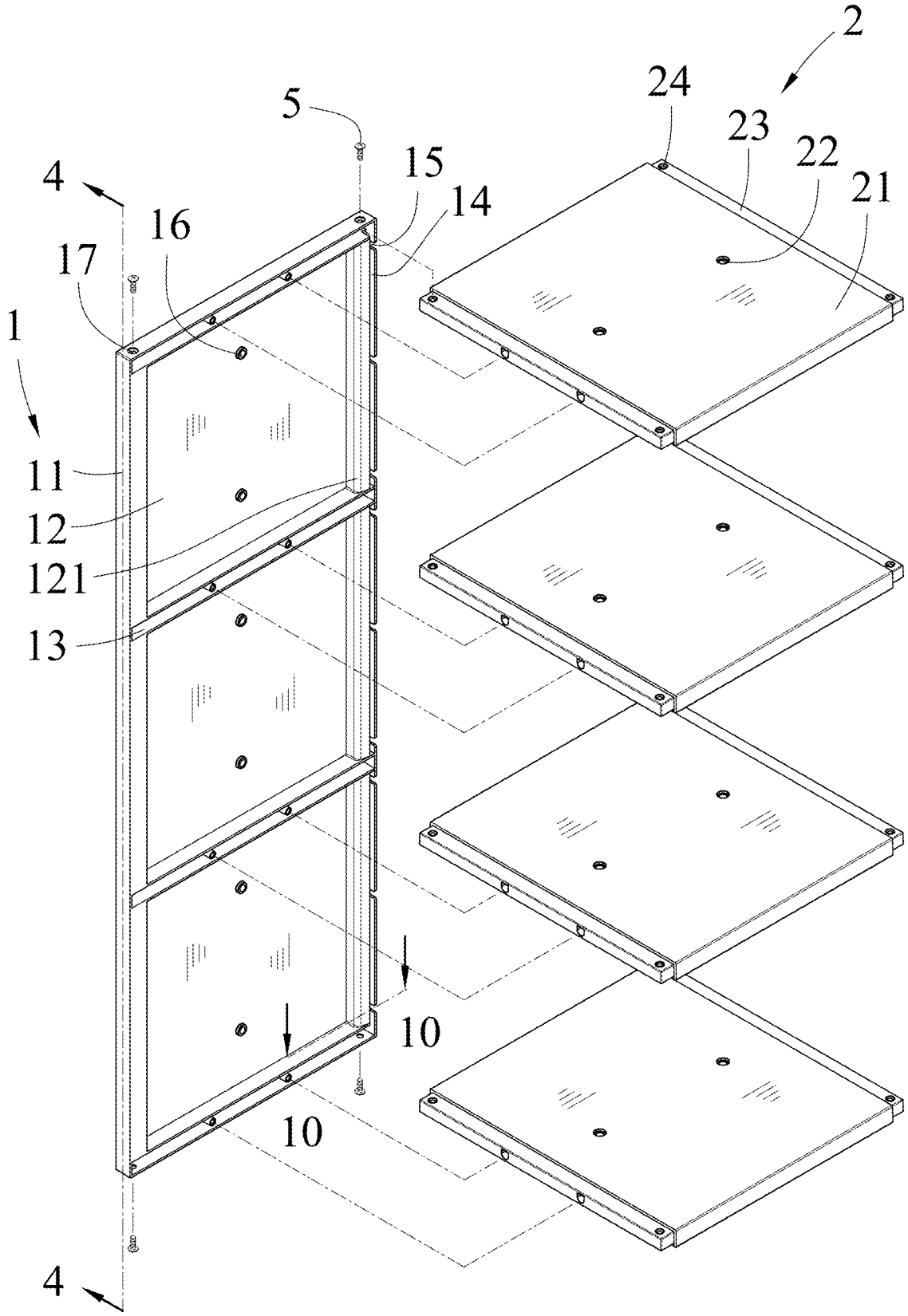
FIG. 3 is a partial exploded perspective view of the storage box structure in accordance with the preferred embodiment of the present invention.
Figure 4:
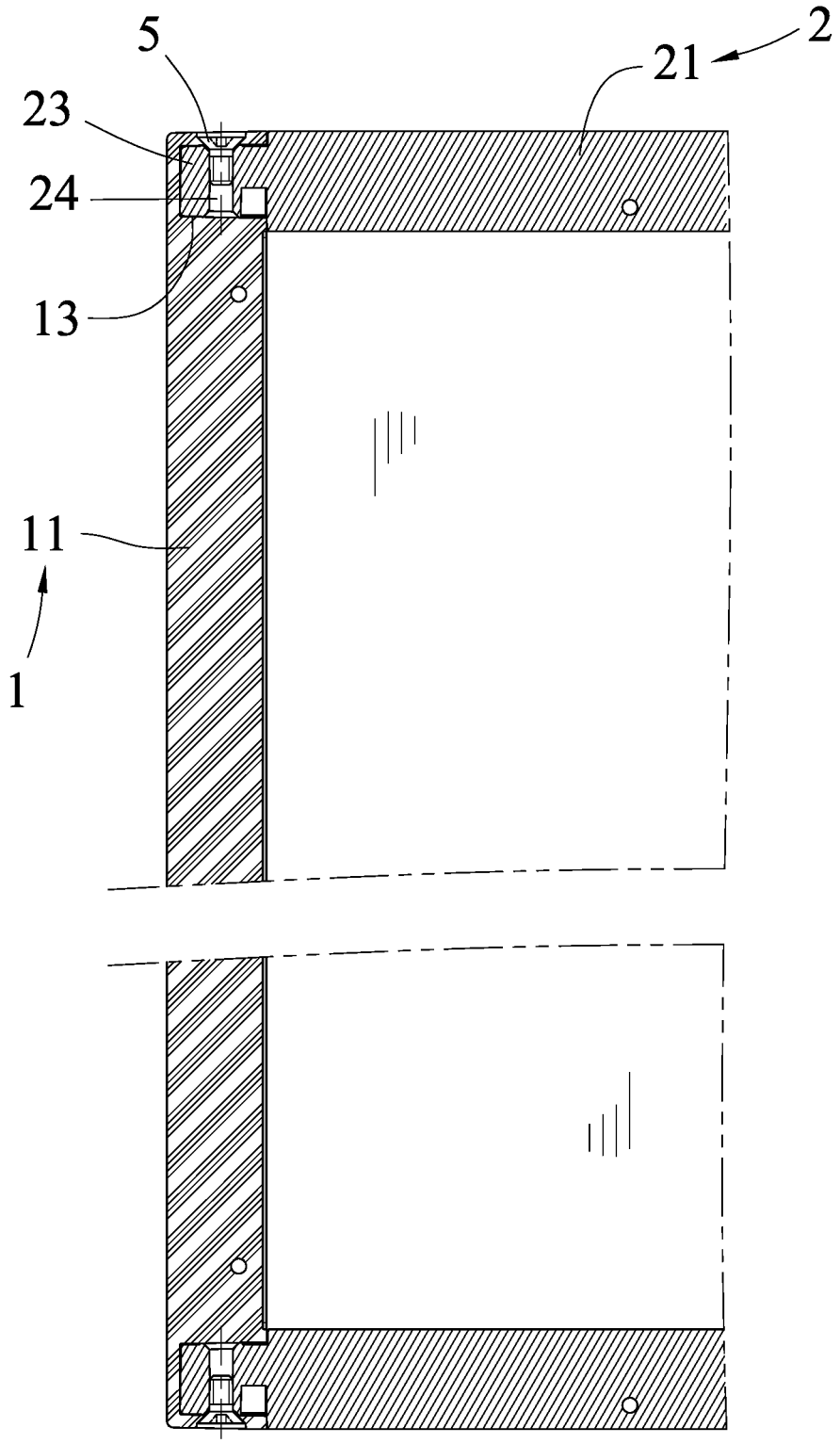
FIG. 4 is a cross-sectional view of the storage box structure as shown in FIG. 3.
Figure 5:
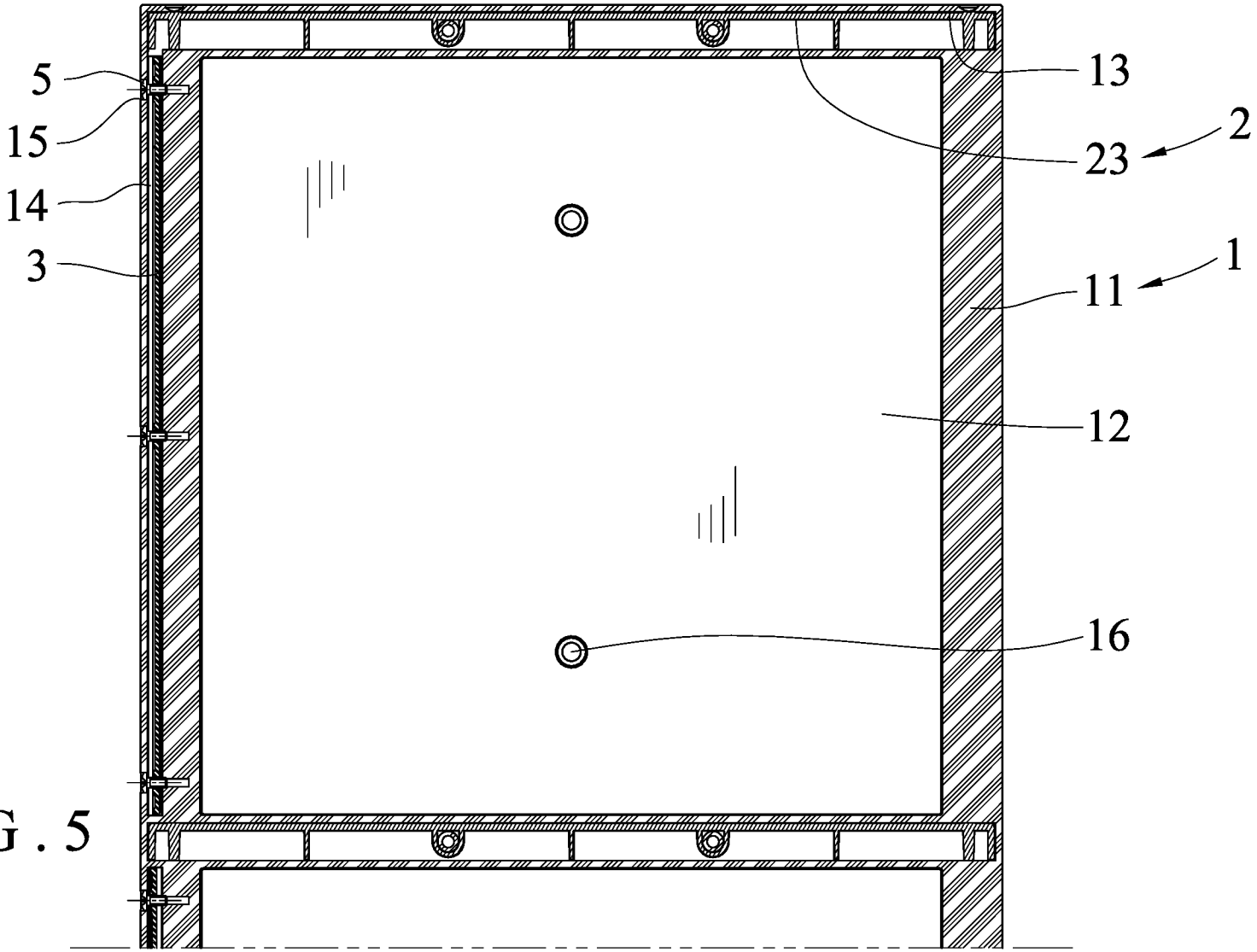
FIG. 5 is a partial cross-sectional view showing assembly of the side boards and the at least one back board.

Referring to the drawings and initially to FIGS. 1-5, a storage box structure in accordance with the preferred embodiment of the present invention comprises two side boards 1, at least two laminates (or plywoods or support boards or layer boards) 2, multiple screws 5, and at least one back board 3.

The two side boards 1 are upright and arranged in parallel. Each of the two side boards 1 has a side board body 11. The side board body 11 has a first face provided with at least one recess 12, at least two first slots 13, and at least one second slot 14. The at least two first slots 13 are arranged serially and linearly from an upper edge to a lower edge of the side board body 11. The at least two first slots 13 are parallel with each other. The at least one recess 12 lies (or is disposed) between the at least two first slots 13. The at least one second slot 14 lies (or is disposed) between a side of the at least one recess 12 and a side of the side board body 11. A predetermined angle is defined between the at least one second slot 14 and each of the at least two first slots 13. Preferably, the predetermined angle is a right angle. The side board body 11 has a second face provided with multiple first screw holes 16 penetrating the side board body 11 and connected to the at least one recess 12. Each of the upper edge and the lower edge of the side board body 11 is provided with multiple perforations 17 connected to each of the at least two first slots 13. The two side boards 1 are arranged symmetrically. The at least two first slots 13 of the two side boards 1 align with each other. The at least one second slots 14 of the two side boards 1 align with each other.

The at least two laminates 2 are parallel with each other. Each of the at least two laminates 2 has a laminate body 21. The laminate body 21 has a top face provided with multiple second screw holes 22 penetrating the laminate body 21. The laminate body 21 is provided with two insert portions 23 extending from two sides of the laminate body 21. Each of the two insert portions 23 is provided with multiple two-way screw bores 24 which are directed toward a direction the same as that of the second screw holes 22. The at least two laminates 2 are located between the two side boards 1. Each of the two insert portions 23 of each of the at least two laminates 2 is inserted into each of the at least two first slots 13 of one of the two side boards 1. The two-way screw bores 24 of each of the at least two laminates 2 align with the perforations 17 of one of the two side boards 1. The screws 5 extend through the perforations 17 of each of the two side boards 1 from top to bottom and are screwed into the two-way screw bores 24 of an uppermost one of the at least two laminates 2 so that the uppermost one of the at least two laminates 2 is locked onto each of the two side boards 1. The screws 5 extend through the perforations 17 of each of the two side boards 1 from bottom to top and are screwed into the two-way screw bores 24 of a lowermost one of the at least two laminates 2 so that the lowermost one of the at least two laminates 2 is locked onto each of the two side boards 1.

It is noted that, each of the two insert portions 23 of each of the at least two laminates 2 is inserted into each of the at least two first slots 13 of one of the two side boards 1, so that after the uppermost one and the lowermost one of the at least two laminates 2 are locked onto each of the two side boards 1, the rest ones of the at least two laminates 2 are fixed between the two side boards 1.

The at least one back board 3 is located between the two side boards 1. The at least one back board 3 has two sides each inserted into and locked in the at least one second slot 14 of one of the two side boards 1, so that the at least one back board 3 is upright between the at least two laminates 2.

In the preferred embodiment of the present invention, the side of the at least one recess 12 is provided with a guide face 121 (see FIG. 10) having a predetermined curvature. The at least one second slot 14 lies between the side of the at least one recess 12 defining the guide face 121 and the side of the side board body 11.

In the preferred embodiment of the present invention, the side board body 11 is provided with at least one cutout 15 located beside the at least one second slot 14. The at least one cutout 15 is connected to the at least one second slot 14. At least one screw extends through the at least one cutout 15 and the at least one back board 3, and is locked in the at least one second slot 14. Thus, the at least one back board 3 is locked in the at least one second slot 14.

In assembly, referring to FIG. 1 with reference to FIGS. 2-5, after the storage box structure is assembled as shown in FIG. 1, a storage space is defined between the at least two laminates 2. Thus, articles are placed on the at least two laminates 2.

Figure 6:
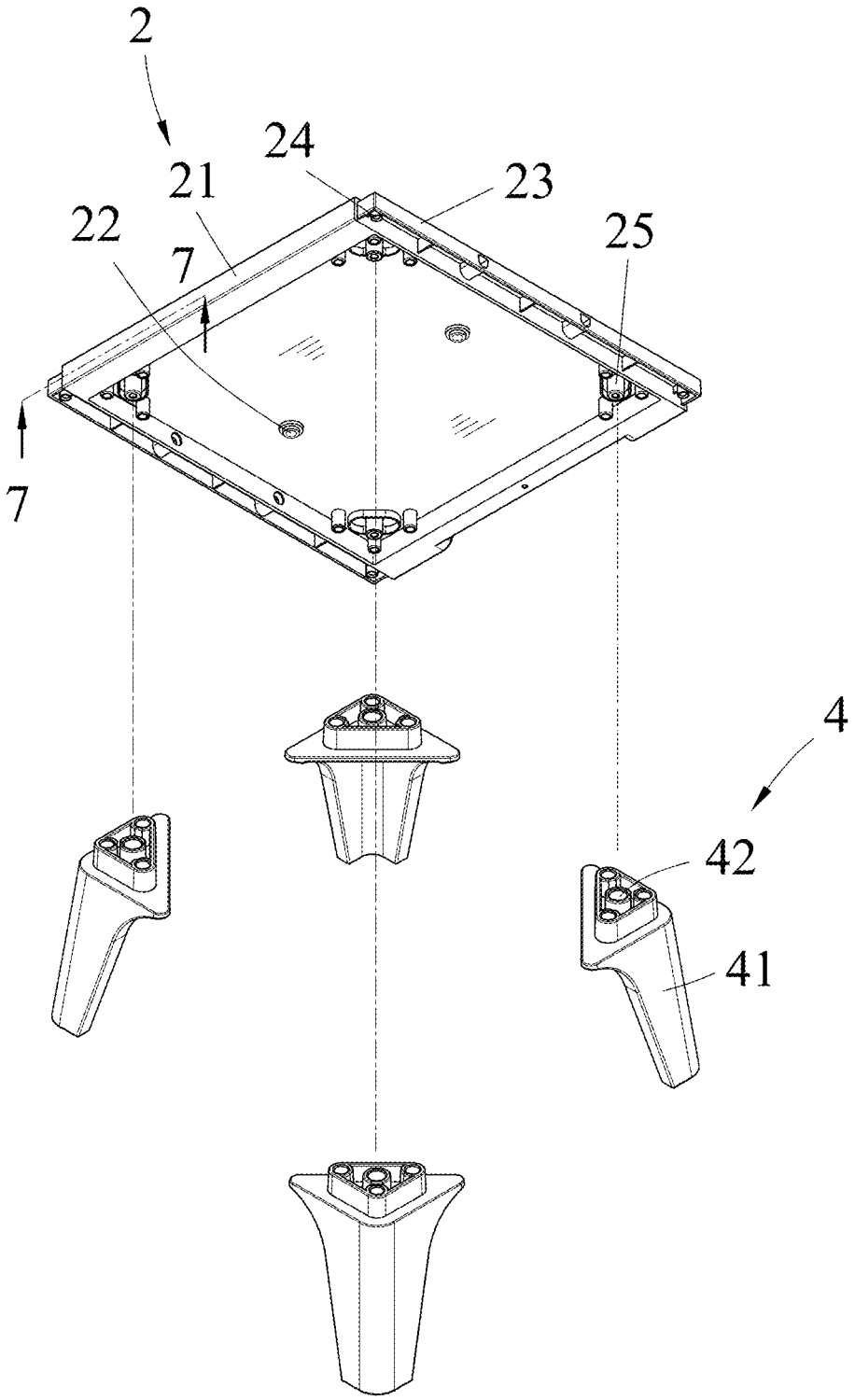
FIG. 6 is a partial exploded perspective view of the storage box structure in accordance with the preferred embodiment of the present invention.
Figure 7:
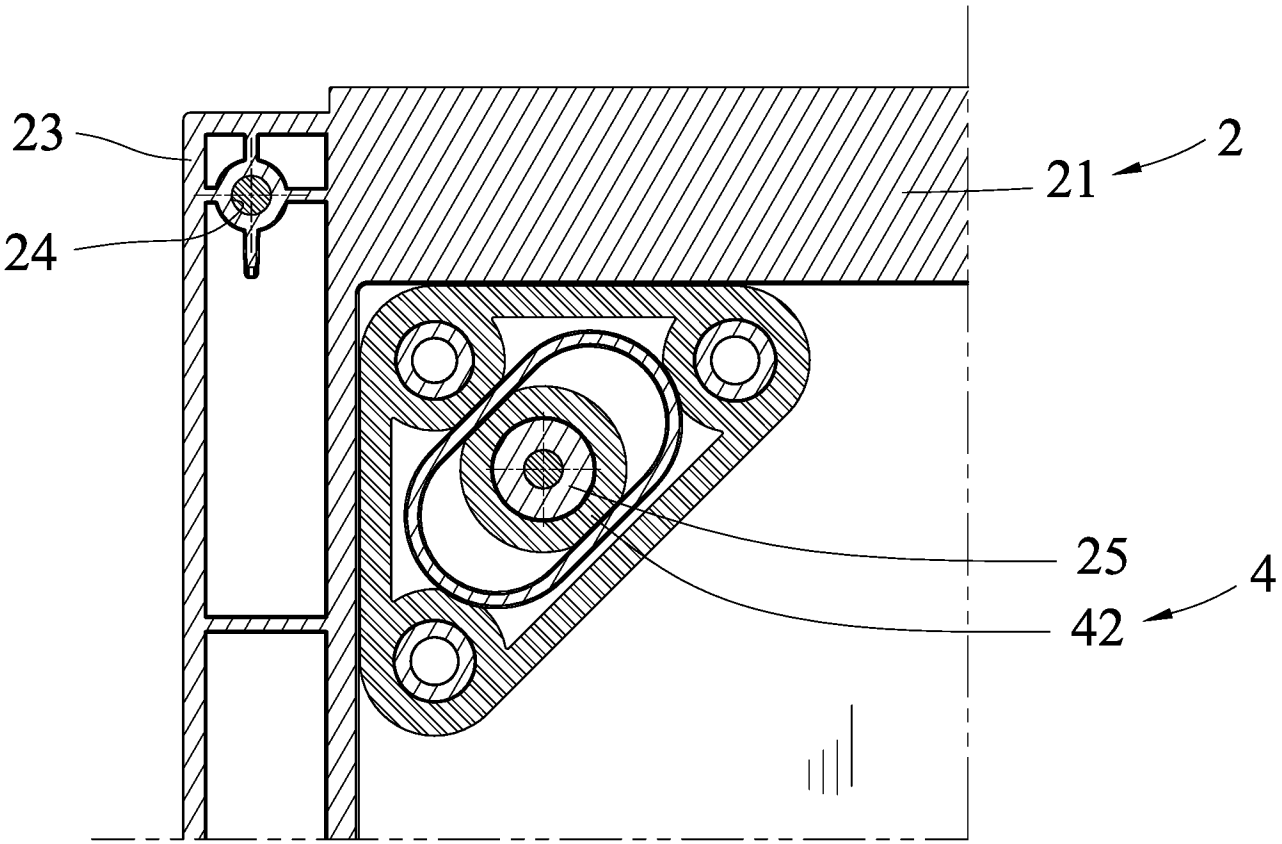
FIG. 7 is a partial cross-sectional assembly view of the storage box structure as shown in FIG. 6.

Referring to FIGS. 6 and 7, the storage box structure further comprises multiple stands 4. Each of the stands 4 has a base 41. The base 41 has a top formed with multiple first mounting portions 42 protruding outward. The laminate body 21 has a bottom face formed with multiple second mounting portions 25 protruding outward. The first mounting portions 42 of each of the stands 4 are mounted on the second mounting portions 25 of the lowermost one of the at least two laminates 2. One of the first mounting portions 42 of each of the stands 4 is locked on one of the second mounting portions 25 as shown in FIG. 7.

As shown in FIG. 1, the storage box structure comprises four laminates 2 and three back boards 3.

Figure 8:
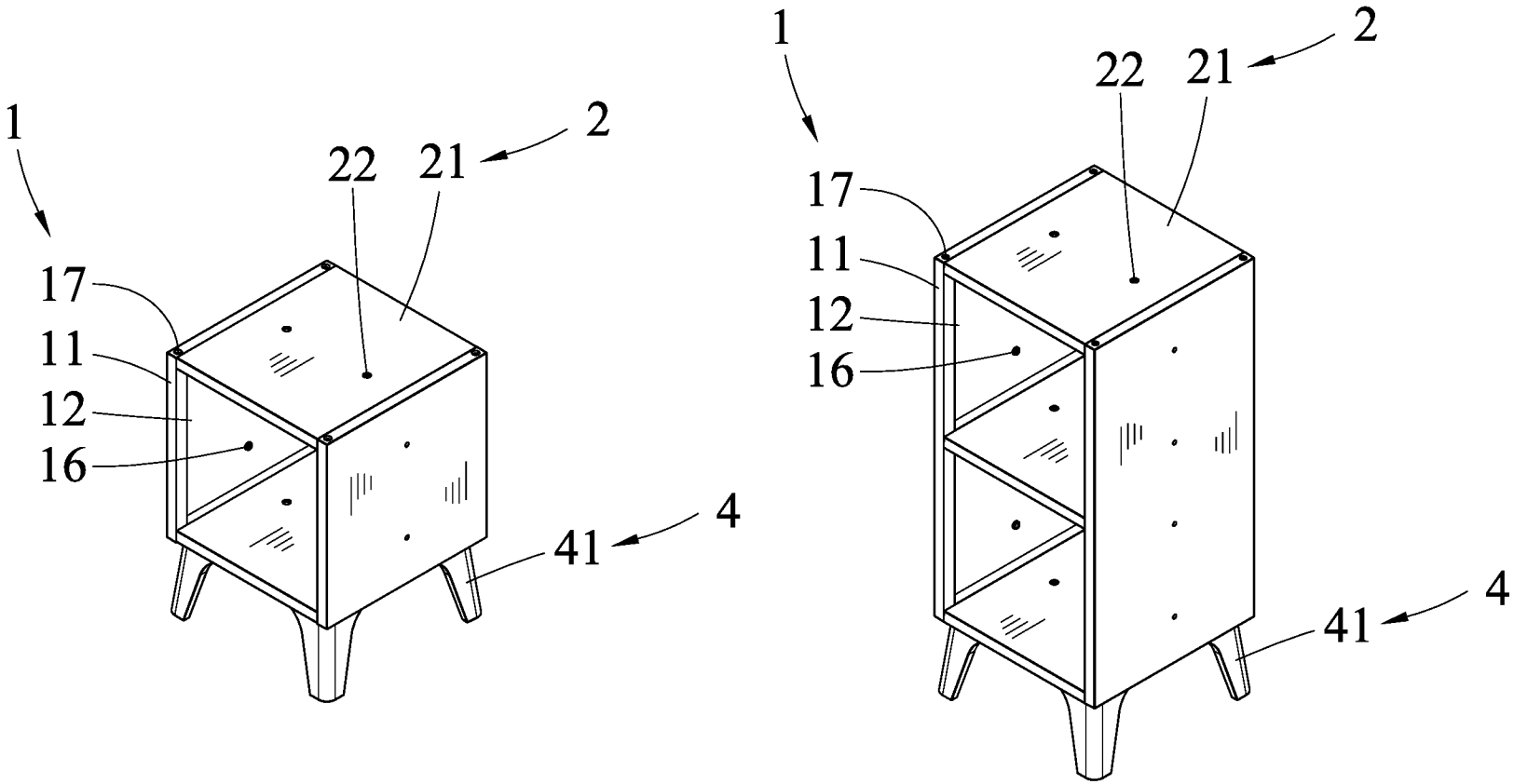
FIG. 8 shows two storage box structures with different numbers of laminates.

Referring to FIG. 8, the storage box structure comprises two laminates 2 and one back board 3. Alternatively, the storage box structure comprises three laminates 2 and two back boards 3. Thus, the number of the back boards 3 is one less than that of the laminates 2.

Figure 9:
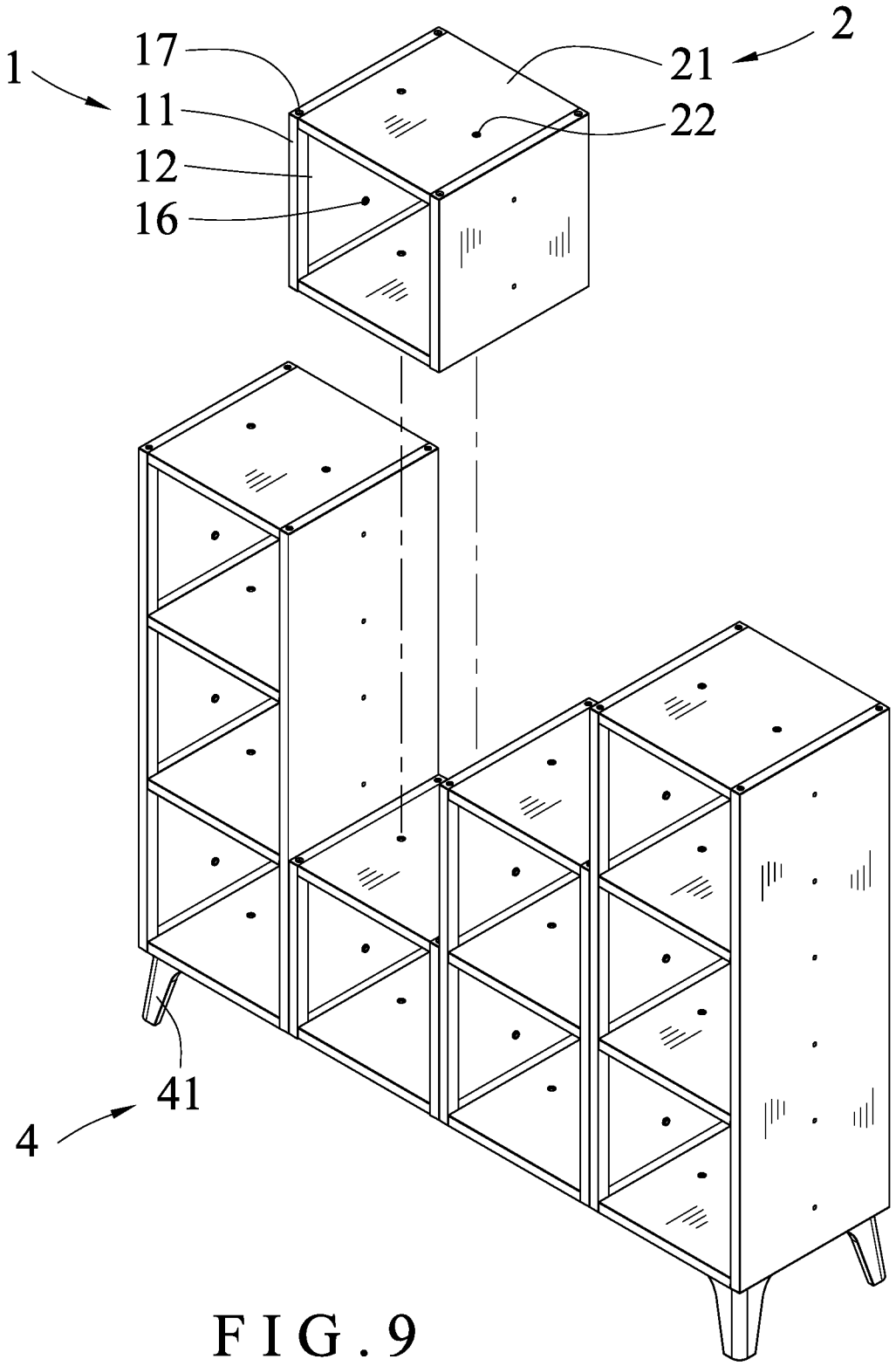
FIG. 9 shows assembly of multiple storage box structures with different numbers of laminates.

Referring to FIG. 9 with reference to FIGS. 1-8, any two adjacent storage box structures are assembled through the first screw holes 16, and any two stacked storage box structures are assembled through the second screw holes 22. Thus, multiple storage box structures are assembled freely according to the user's requirement.

Figure 10:
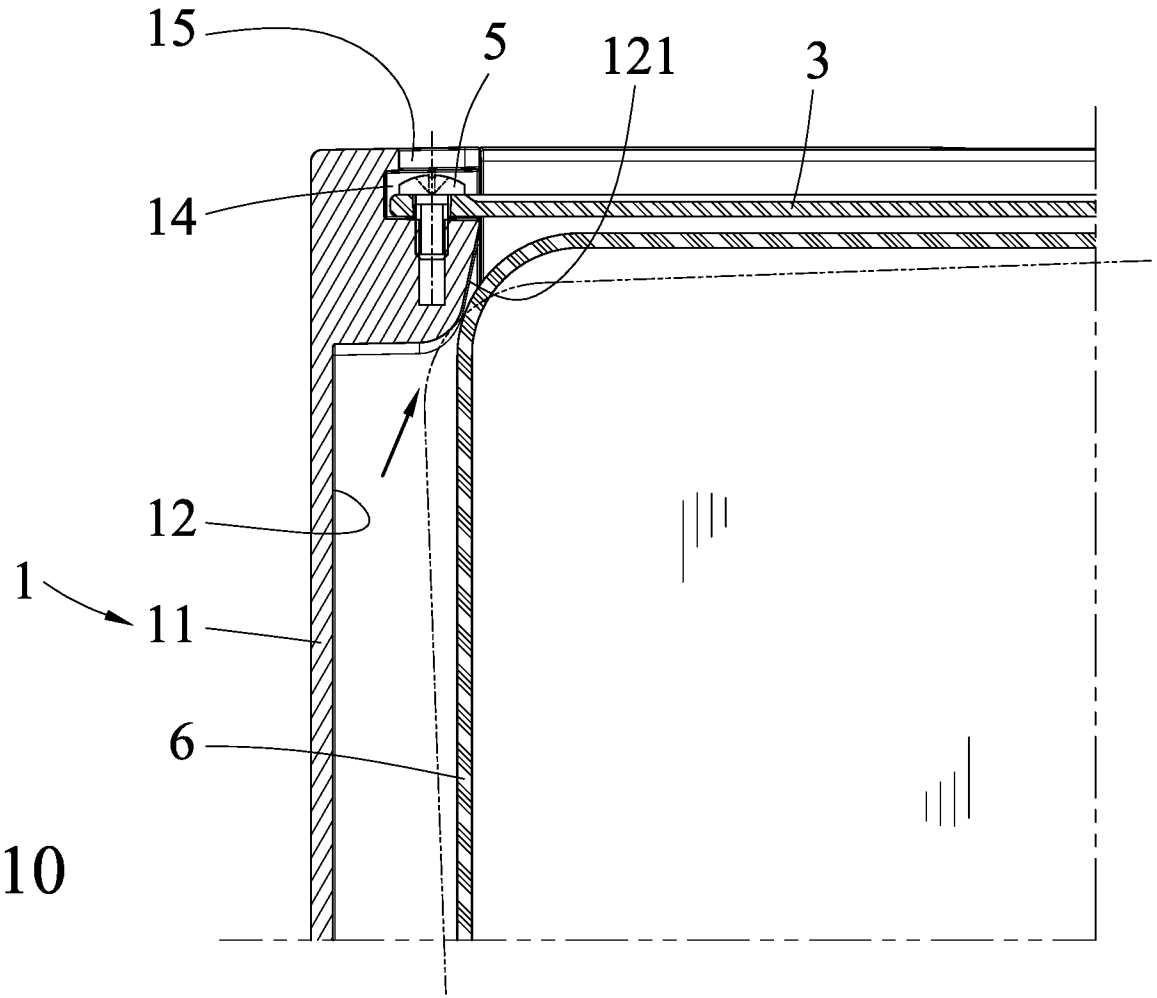
FIG. 10 is a partial cross-sectional view showing the function of a guide face of the storage box structure.

Referring to FIG. 10, when a drawer 6 is inserted into the storage space, the guide face 121 is used to guide movement of the drawer 6 until the drawer 6 touches the at least one back board 3.

Accordingly, the storage box structure comprises laminates 2 of different numbers including two, three, four or the like. In addition, any two adjacent storage box structures are assembled through the first screw holes 16, and any two stacked storage box structures are assembled through the second screw holes 22. Thus, multiple storage box structures are assembled freely to form a storage cabinet with different storage spaces to satisfy the user's various requirement.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A storage box structure comprising:

two side boards, at least two laminates, multiple screws, and at least one back board;

wherein:

the two side boards are upright and arranged in parallel;

each of the two side boards has a side board body;

the side board body has a first face provided with at least one recess, at least two first slots, and at least one second slot;

the at least two first slots are arranged serially and linearly from an upper edge to a lower edge of the side board body;

the at least two first slots are parallel with each other;

the at least one recess lies between the at least two first slots;

the at least one second slot lies between a side of the at least one recess and a side of the side board body;

a predetermined angle is defined between the at least one second slot and each of the at least two first slots;

the side board body has a second face provided with multiple first screw holes penetrating the side board body and connected to the at least one recess;

each of the upper edge and the lower edge of the side board body is provided with multiple perforations connected to each of the at least two first slots;

the two side boards are arranged symmetrically;

the at least two first slots of the two side boards align with each other;

the at least one second slot of the two side boards align with each other;

each of the at least two laminates has a laminate body;

the laminate body has a top face provided with multiple second screw holes penetrating the laminate body;

the laminate body is provided with two insert portions extending from two sides of the laminate body;

each of the two insert portions is provided with multiple two-way screw bores which are directed toward a direction a same as that of the second screw holes;

the at least two laminates are located between the two side boards;

each of the two insert portions of each of the at least two laminates is inserted into each of the at least two first slots of one of the two side boards;

the two-way screw bores of each of the at least two laminates align with the perforations of one of the two side boards;

the screws extend through the perforations of each of the two side boards from top to bottom and are screwed into the two-way screw bores of an uppermost one of the at least two laminates so that the uppermost one of the at least two laminates is locked onto each of the two side boards;

the screws extend through the perforations of each of the two side boards from bottom to top and are screwed into the two-way screw bores of a lowermost one of the at least two laminates so that the lowermost one of the at least two laminates is locked onto each of the two side boards;

the at least one back board is located between the two side boards; and the at least one back board has two sides each inserted into and locked in the at least one second slot of one of the two side boards.

2. The storage box structure as claimed in claim 1, wherein the side of the at least one recess is provided with a guide face having a predetermined curvature, and the at least one second slot lies between the side of the at least one recess defining the guide face and the side of the side board body.

3. The storage box structure as claimed in claim 1, wherein:

the side board body is provided with at least one cutout located beside the at least one second slot;

the at least one cutout is connected to the at least one second slot; and at least one screw extends through the at least one cutout and the at least one back board, and is locked in the at least one second slot.

4. The storage box structure as claimed in claim 1, further comprising:

multiple stands;

wherein:

each of the stands has a base;

the base has a top formed with multiple first mounting portions protruding outward;

the laminate body has a bottom face formed with multiple second mounting portions protruding outward;

the first mounting portions of each of the stands are mounted on the second mounting portions of the lowermost one of the at least two laminates; and one of the first mounting portions of each of the stands is locked on one of the second mounting portions.

* * * * *